US005899025A

United States Patent [19]

Casey et al.

[11] Patent Number: 5,899,025

[45] Date of Patent: May 4, 1999

[54] FURNITURE SYSTEM (PATHWAYS-SPACEFRAME)

[75] Inventors: Daniel S. Casey, Grand Rapids; Ronald A. Dykstra, Grandville; Carl V. Forslund, III, Grand Rapids, all of Mich.; Peter C. Greenberg, Somerville, Mass.

[73] Assignee: Steelcase Inc., Grand Rapids, Mich.

[21] Appl. No.: 08/621,164

[22] Filed: Mar. 22, 1996

[51] Int. Cl.[6] ..... E04B 2/76

[52] U.S. Cl. ..... 52/36.1; 52/220.7; 52/239; 160/351; 160/135; 108/50.02

[58] Field of Search ..... 52/220.7, 36.1, 52/36.6, 126.1, 239, 241, 243, 730.1; 160/135, 351; 312/223.6, 242; 108/50.02

[56] References Cited

U.S. PATENT DOCUMENTS

| | | | |
|---|---|---|---|
| 2,888,113 | 5/1959 | Schwartz et al. | 189/85 |
| 2,969,565 | 1/1961 | Levy | 20/4 |
| 3,451,183 | 6/1969 | Lespagnol et al. | 52/656 |
| 3,513,606 | 5/1970 | Jones | 52/27 |
| 3,642,310 | 2/1972 | Hudson | 387/52 A |
| 3,725,568 | 4/1973 | Stanley | 174/48 |
| 3,845,601 | 11/1974 | Kostecky | 52/290 |
| 3,971,172 | 7/1976 | Gentil | 52/28 |
| 4,034,535 | 7/1977 | Dustmann | 52/727 |
| 4,065,890 | 1/1978 | Fenner | 52/27 |
| 4,205,497 | 6/1980 | Schirm | 52/90 |
| 4,224,769 | 9/1980 | Ball et al. | 52/36 |
| 4,458,461 | 7/1984 | Holley | 52/239 |
| 4,470,232 | 9/1984 | Condevaux et al. | 52/220 |
| 4,606,394 | 8/1986 | Bannister | 160/351 |
| 4,630,417 | 12/1986 | Collier | 52/263 |
| 4,646,211 | 2/1987 | Gallant et al. | 362/149 |
| 4,750,305 | 6/1988 | Bastian | 52/127.11 |
| 4,771,583 | 9/1988 | Ball et al. | 52/221 |
| 4,863,223 | 9/1989 | Weissenbach et al. | 312/209 |
| 4,876,835 | 10/1989 | Kelley et al. | 52/239 |
| 5,033,526 | 7/1991 | DeLong et al. | 160/135 |
| 5,150,554 | 9/1992 | Quinlan, Jr. et al. | 52/282 |
| 5,155,955 | 10/1992 | Ball et al. | 52/126.4 |
| 5,172,530 | 12/1992 | Fishel et al. | 160/351 X |
| 5,271,204 | 12/1993 | Wolf et al. | 52/730.1 |
| 5,298,681 | 3/1994 | Swift et al. | 174/48 |
| 5,326,934 | 7/1994 | LeMaster et al. | 174/59 |
| 5,362,923 | 11/1994 | Newhouse et al. | 174/48 |
| 5,394,658 | 3/1995 | Schreiner et al. | 52/36.1 |
| 5,511,348 | 4/1996 | Cornell et al. | 52/239 |
| 5,675,949 | 10/1997 | Forslund et al. | 52/220.7 |

FOREIGN PATENT DOCUMENTS

| | | |
|---|---|---|
| 0514862 | 11/1992 | European Pat. Off. . |
| 2647180 | 11/1990 | France . |
| 2221938 | 2/1990 | United Kingdom . |
| 2235621 | 3/1991 | United Kingdom . |

*Primary Examiner*—Carl D. Friedman
*Assistant Examiner*—Winnie S. Yip
*Attorney, Agent, or Firm*—Price, Heneveld, Cooper, DeWitt & Litton

[57] ABSTRACT

An integrated prefabricated furniture system is provided for fitting-out a building room of the type having a generally open plan interior and having at least one utility source. The furniture system includes a plurality of horizontal beam segments interconnected in an end-to-end fashion to form a rigid overhead framework configured to be positioned above the floor surface. A plurality of overhead support columns each have an upper portion rigidly connected with the overhead framework, and a lower portion shaped to support the overhead framework on a floor in a freestanding fashion at a predetermined elevation above average user height. Each of the overhead support columns includes an interior support structure in a generally X-shaped plan-form defining vertical raceways between adjacent legs of the cross-section. Each support column also includes four vertical edges forming substantially planar faces therebetween, of which at least one of the vertical edges has a plurality of slots for supporting office furniture items and office accessories.

50 Claims, 6 Drawing Sheets

FURNITURE SYSTEM (PATHWAYS-SPACEFRAME)

CROSS-REFERENCES TO RELATED APPLICATIONS

The present application is related to the following, commonly assigned, copending United States patent applications which are hereby incorporated by reference.

| Title | Ser. No. | Filing Date | U.S. Pat. No. |
|---|---|---|---|
| Furniture Systems | 07/774,563 | 10-08-91 | 5,517,348 |
| Utility Floor Construction | 08/063,500 | 05-18-93 | 5,483,776 |
| Utility Distribution System | 08/063,463 | 05-18-93 | 5,794,392 |
| Portable Partition System | 08/367,802 | 12-30-94 | 5,746,034 |
| Furniture System (COMMONS/PATHWAYS) | 08/450,255 | 05-25-95 | 5,724,778 |
| Integral Prefabricated Finished System for Building Space (PATHWAYS-ZONE WALL AND SPACE FRAME) | 08/450,820 | 05-25-95 | Abandoned |

BACKGROUND OF THE INVENTION

The present invention relates to furnishings, and in particular to a furniture system that is particularly adapted to support group activities in open plans, and the like.

Open office plans are well known in the art, and generally comprise large, open floor spaces in a building that are furnished in a manner that is readily reconfigurable to accommodate the ever changing needs of a specific user, as well as the divergent requirements of different tenants. One arrangement typically used for furnishing open plans includes movable partition panels that are detachably interconnected to partition off the open space into individual workstations and/or offices. Some such partition panels are configured to receive hang-on furniture units, such as worksurfaces, overhead cabinets, shelves, etc., and are generally known in the office furniture industry as "systems furniture." Another arrangement for dividing and/or partitioning open plans includes modular furniture arrangements in which a plurality of differently shaped, freestanding furniture units are interconnected in a side-by-side relationship, with upstanding privacy screens attached to at least some of the furniture units to create individual, distinct workstations and/or offices.

Such prior art partitioning arrangements create relatively permanent, multifunction workstations for the users, which workstations are required to support both individual work activities, as well as some types of group activities, such as inter-office conferences, and the like. However, these types of conventional workstation arrangements are not particularly adapted to support workers engaged in group work, such as self-managing teams, or others involved in team problem solving techniques, wherein a relatively large number of workers from different disciplines, such as engineering, design, manufacturing, sales, marketing, purchasing, finance, etc., meet together as a group to define and review issues, set general policy, and then break out into a number of smaller sub-groups or individuals to resolve those specific problems relating to their particular discipline. Team projects typically have a rather specific objective and are of a limited duration, such that the individual workers are temporarily assigned to the group for the life of the project, and are then reassigned to a new group when the project is completed. Group work is steadily gaining importance as a way of improving productivity and time-to-market, thereby emphasizing the need to support such activities more efficiently and effectively.

Conventional conference rooms, meeting halls, and the like have heretofore been required to handle such group meetings, but are typically expensive to construct and maintain, and are not usually considered an efficient use of space in open plan environments. When such conventional rooms are constructed in rented office space, they become permanent leasehold improvements, which must be depreciated over a lengthy time period, and can not be readily removed upon the expiration of the lease. The reconfiguration of such spaces is quite messy, and very disruptive to conducting day-to-day business. Furthermore, with conventional conference room arrangements, breakout meetings among the various sub-groups of workers often prove inconvenient, since the workstations of the participant workers are seldom located in close proximity to the conference room.

Another objective of furnishings from modern office environments is to promote the establishment of an optimum balance between worker privacy and worker interaction. Throughout a given workday, an office worker normally oscillates between interaction with others and time spent alone. Each such worker actively seeks out or avoids others based upon their ever changing task, objectives, and goals. Furnishings can serve to help these workers better regulate involvement with or isolation from coworkers. For example, full height offices are known for privacy. Their surrounding walls and door provide privacy by consistently controlling unwanted distractions, but often limit opportunities for spontaneous interaction. On the other hand, open offices precipitate an awareness of coworkers. Furniture and partition based workstations encourage participation and convenient access, but often lack sufficient controls for individual quiet work. Both private workspace and convenient access to coworkers for the completion of work involving group or team efforts is quite important to the overall success of such projects.

The use of displays to communicate information to large groups in office environments and the like, is also generally well-known, and includes such devices as marker boards, tackable surfaces, electronic displays, reflective projector screens, etc. Such displays are normally incorporated into conventional style conference rooms, meeting halls, and other similar facilities. However, as previously noted, such conventional meeting spaces are typically expensive, and are not usually considered a cost effective use of floor space in most modern offices. Rather, modern office layouts are typically of the open plan type, and do not include large, conventional types of conference rooms.

Information displays in modern, open plan workstations, such as those created by movable partition panels, modular furniture, or the like, are usually quite limited, and not particularly adapted to support workers engaged in group or team problem solving techniques. Due to the inherent nature of group problem solving techniques, the effective display of information is quite important to the effective management of the team's human resources.

Office space users are experiencing increasing needs for improved utilities support at each workstation or work setting. These "utilities," as the term is used herein, encompass all types of resources that may be used to support or service a worker, such as communications and data used with computers and other types of data processors, telecommunications, electronic displays, electrical power, and physical accommodations, such as lighting, signage, security, sound masking, and the like. For example, modern offices for highly skilled "knowledge workers" such as engineers, accountants, stock brokers, computer programs, etc., are typically provided with multiple pieces of very specialized computer and communications equipment that are capable of processing information from numerous local and remote data sources to assist in solving complex problems. Such equipment has very stringent power and signal requirements, and must quickly and efficiently interface with related equipment at both adjacent and remote locations. Many other types of high technology equipment and facilities are also presently being developed which will need to be accommodated in the workplaces of the future.

In order to gain increased efficiency in the use of expensive office real estate, attempts are now being made to try to support highly paid knowledge workers with modular furniture systems in open office settings, instead of conventional private offices. However, in order to ensure peak efficiency of such knowledge workers, the work settings must be equipped with the various state-of-the-art utilities and facilities. Since such work settings must be readily reconfigurable to effectively meet the ever-changing needs of the user, the distribution and control of utilities throughout a comprehensive open office plan has emerged as a major challenge to the office furniture industry. The inherent nature of modular furniture system, which permits them to be readily reconfigurable into different arrangements, makes it very difficult to achieve adequate utility distribution and control.

Hence, utility distribution and control are fast becoming one of the major issues in office fit-out and furniture. Changing technology is creating greater demands on power and signal distribution networks. Routing power and signal distribution below the floor or in furniture systems often ends up in complex idiosyncratic systems which are difficult to manage or change. There is presently an oversupply of office space and furniture systems which do not properly respond to or support change. Many older buildings do not have adequate utility capabilities and the cost of conventional renovations or improvements often renders the same in practice. Even relatively new buildings can quickly be rendered obsolete by the fast paced changes in modern technology. The refurnishing of existing building space is therefore a concern which must be addressed by furniture systems.

SUMMARY OF THE INVENTION

An integrated prefabricated furniture system is provided for fitting out a building room with an associated floor surface and having variety of office plan applications and also having an associated utility in-feed (from a floor, a system wall, an architectural wall or a ceiling).

The furniture system includes an overhead framework having a plurality of horizontal beam segments interconnected in an end-to-end fashion to form a rigid structure configured to be positioned above the floor surface.

The furniture system further includes a plurality of overhead support columns, each having an upper portion thereof connected with the overhead framework, and a lower portion thereof shaped to abut the floor surface and thereby support the overhead framework thereon in a freestanding fashion at a predetermined elevation above average user height. Each of the overhead support columns further include an interior support structure, and at least three vertical edges forming substantially planar faces therebetween, of which at least one vertical edge has a plurality of slots therethrough for supporting office furniture items and office accessories.

Another aspect of the present invention is the furniture system including the overhead framework having a plurality of horizontal beam segments interconnected in an end-to-end fashion forming a rigid structure configured to be positioned above the floor surface. The framework is supported by a plurality of overhead support columns. The overhead support columns have an interior support structure configured to form parallel vertical raceways for routing utility conduits within the support column. The support column also provides for the routing of at least one utility conduit to be routed from under a floor surface to the overhead framework when the overhead support column is aligned with a portion of the raceway under the floor.

A further aspect of the present invention is an overhead framework as described above forming a rigid structure supported by overhead support columns. The support columns having a beltway defined at an intermediate portion of the column such that utilities routed within the column can be terminated at the beltway for access by a user. Another aspect of the present invention are horizontal beams which interconnected in an end-to-end fashion to form the overhead framework. The horizontal beams have one or more raceways for routing utility conduits and are adapted to mount power distribution blocks for the further distribution of utilities to the user. The horizontal beams also include one or more J-shaped channels depending from the bottom of the beam for hanging office panels thereon such as marker boards, privacy screens, or projection screens.

Another aspect of the present invention is the large number of application uses. The overhead framework and support columns may be freestanding in an open configuration (as in an open plan environment) or some spaceframe elements can be adjacent to other wall elements. The present invention can be applied as a square or rectangle or grid of repeated elements. The column and beam elements can be combined to create connectors in a variety of configurations: 2 beams meeting at 90° ('L'- configuration), 3 beams meeting at 90° ('T'-configuration), 4 beams meeting at 90° ('X'- configuration), or in-line connectors. Separate elements can also be used individually as well, such as a beam can be used as an overhead utility bridge between two Zone wall elements.

These and other features, advantages, and objects of the present invention will be further understood and appreciated by those skilled in the art by reference to the following specification, claims and appended drawings.

DETAILED DESCRIPTION OF THE PREFERRED EMBODIMENTS

Figure 1:
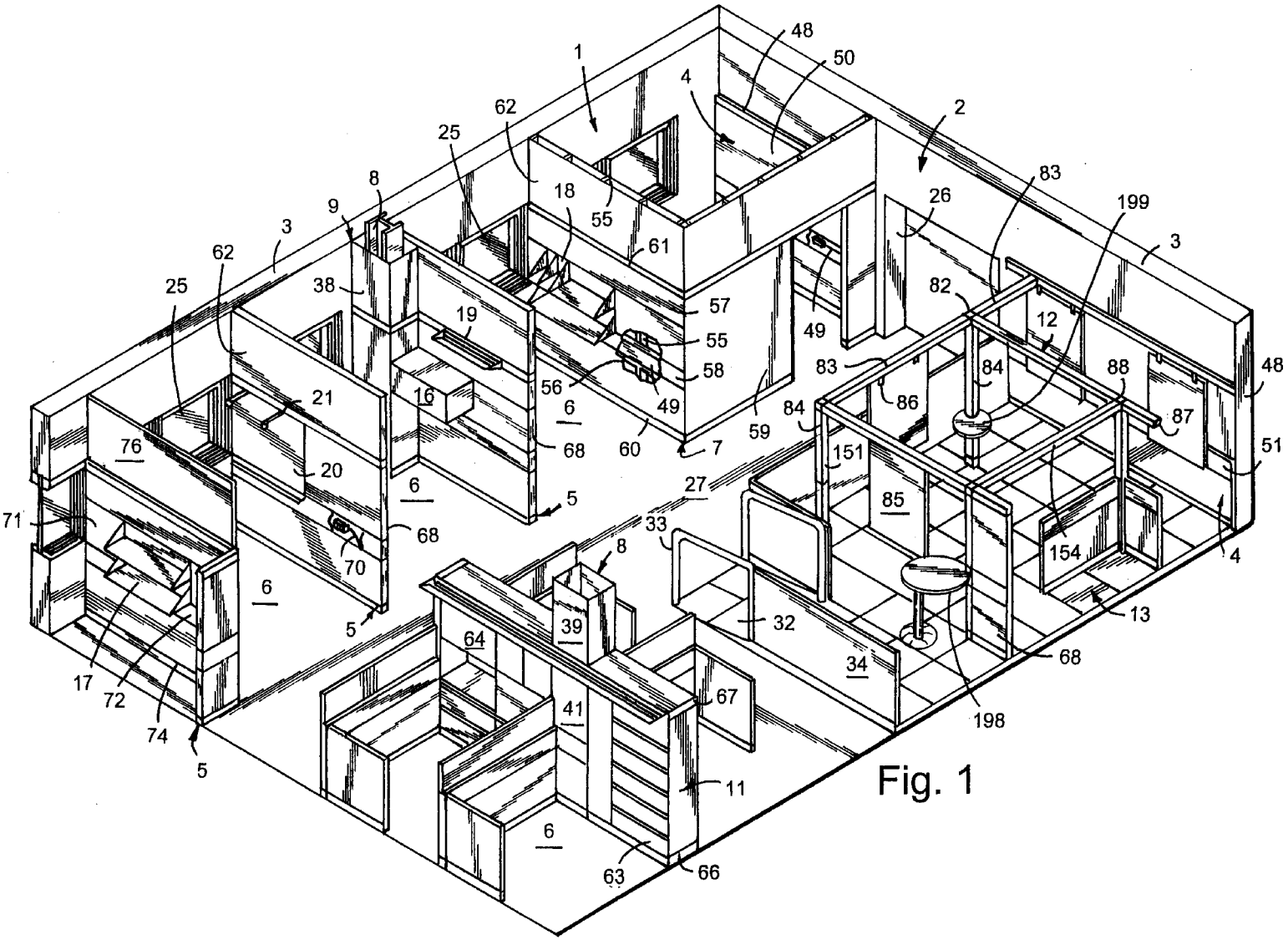
FIG. 1 is a perspective view of a column and beam system in an integrated prefabricated furniture system embodying the present invention.

For purposes of description herein the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 1 (FIG. 1) generally designates an integrated prefabricated furniture system embodying the present invention. Those skilled in the art will understand from the discussion of the preferred embodiment that although FIG. 1 illustrates the invention in a substantially freestanding application on a raised floor, the invention can be integrated in varying degrees with other furniture system components such as Plus wall 4, Zone wall 5, and Link wall 7. Furniture system 1 is particularly adapted for finishing or fitting-out building space, rooms etc., 2 of the type having a generally open plan interior defined by fixed interior and exterior walls 3. Such building spaces 2 are typically designed for use as offices, facilities for education/training, hotels/motels, conference centers, medical treatment, and other similar purposes. A demountable architectural wall system 4 (Plus wall) covers the fixed walls 3 of building room 2, a portable partition wall system 5 (Zone Wall) divides the interior space of the building room into individual workstations or work settings 6, and a demountable movable wall system 7 (Link wall) forms custom width partitions. The three wall systems 4, 5, and 7, are completely compatible and fully integrated in both function and appearance. A modular column cover system 8 selectively covers support columns 9 in building room 2, and provides vertical utility routing and storage that integrates with wall systems 4, 5, and 7. A space frame system 12 is particularly beneficial in supporting group activities, and the like, and includes utility raceways which communicate in both function and appearance with wall systems 4, 5, and 7 to effectively and efficiently distribute utilities throughout building room 2 in a variety of applications. A prefabricated low raised floor system 13 is supported directly on the floor of building room 2, and conforms with the various furniture elements to provide support for those work settings 6 requiring maximum utility capabilities. Furniture accessories, such as hang-on binder bins 16, shelves 17, paper managers 18, task lighting 19, displays 20, etc. are designed to be used anywhere throughout furniture system 1. Furniture system 1 is readily reconfigurable to meet the ever-changing needs of the user, and minimize permanent leasehold improvements.

The illustrated raised floor system 13 has a prefabricated construction, and is abuttingly supported directly on the floor surface 7 of building room 2. Although floor system 13 contemplates a wide variety of different constructions, preferably it has a thin-raised construction with a relatively low profile to facilitate easy ingress and egress from floor surface 27 of building room 2. Examples of suitable floor systems 13 are provided in commonly assigned, co-pending U.S. patent applications Ser. No. 08/063,500, filed May 18, 1993, entitled UTILITY FLOOR CONSTRUCTION, as well as Ser. No. 08/063,463, filed May 18, 1993, entitled UTILITY DISTRIBUTION SYSTEM, which have been incorporated herein by reference. Regardless of the specific construction of low raised floor system 13, it has a hollow interior with optional raceways (not shown) therethrough in which utilities are routed to their desired locations. A ramp area 32 of floor system 13 facilitates ingress and egress between floor system 13 and the floor surface 27 of building room 2, while rails 33 and partitions 34 are provided about the open peripheral edges of floor system 13.

The illustrated prefabricated wall system 4, which is also referred to herein as the Plus wall system, is a demountable architectural wall system that is particularly designed for covering the fixed walls 3 of building room 2. Plus wall system 4 includes a plurality of horizontally extending mounting channels 48 which are attached to the fixed walls 3 of building room 2 along upper and lower portions thereof. A plurality of horizontally extending belt zone utility troughs 49 are also provided for attachment to the building room fixed walls 3 at a position vertically between the upper and lower portions thereof, adjacent to standard worksurface height. A plurality of cover panels 50–51 are provided, at least some of which are full width, and have a horizontally elongated front elevational shape. Cover panels 50–51 are detachably mounted on the mounting channels 48 and utility troughs 49 to thereby cover the fixed walls 3. Preferably, mounting channels 48 include a hanger channel on which at least some of the furniture accessories may be supported, including hanging panels, ambient and task lighting, as well as hang-on storage with the use of additive support rails (not shown). The illustrated Plus wall system has both full and partial height segments. In general, Plus wall system 4 is a system of additive architectural wall elements for adding utility and upgrading finish to existing walls.

The illustrated prefabricated wall system 7 which is also referred to herein as the Link wall system, is a demountable movable wall system for forming custom width partitions that are compatible with the Plus wall system 4 and the Zone wall system 5. Link wall system 7 includes a plurality of vertical studs 55, adapted to be positioned in a side-by-side relationship. A plurality of horizontal channels 56 are provided in different lengths and are shaped to be attached to the studs 55 adjacent standard worksurface height to rigidly interconnect the same in a mutually parallel relationship, and forming a belt zone utility trough 49 to permit the continuous routing of utilities therethrough, along with the belt zone utility troughs 49 on Plus wall system 4, as well as Zone wall system 5. A plurality of cover panels 57 and 58 are detachably mounted on the opposite sides of studs 55 to enclose the same. In the example shown the Link wall system 7 has base raceways 60 along the bottom edges of partitions 54, expressway raceways 61 along the top edges of partitions 54, and transoms 62 mounted on top of expressway raceways 61, which extend to the ceiling.

The illustrated prefabricated wall system 5 which is also referred to herein as the Zone wall system, is a portable partition system that spatially defines the open plan interior of the building room 2 into individual and group work settings 6 or may be used to create fully enclosed rooms. Zone wall system 5, which is disclosed in greater detail in commonly assigned, co-pending U.S. patent application Ser. No. 08/367,802, filed Dec. 30, 1994, entitled PORTABLE PARTITION SYSTEM (PATHWAYS-ZONE WALL), which has been incorporated herein, generally includes a plurality of freestanding panels 68 interconnected side-by-side in a predetermined plan configuration. Each Zone wall panel 68 has an internal frame, at least some of which includes a horizontally extending utility raceway 70 positioned adjacent worksurface height. A plurality of cover panels 71–72 are provided, each having a horizontally elongated front elevational shape, and being detachably mounted on opposite sides of the frame to enclose the same. In the illustrated examples, Zone wall panels 68 also include base raceways 74 extending along the bottom edges of the panels, and expressway raceways 61 extending along the top edges of the panels, as well as glass transoms 76 and full transoms 62. The full transoms 62 may have hollow interiors through which wires, cables and other utilities can be routed.

The illustrated space frame system 12 in one application can support group work activities in an open portion of the open plan interior of associated building room 2. Space frame system 12 is completely compatible and fully integrated in both function and appearance with wall systems 4, 5, and 7. An early embodiment of space frame system 12 is disclosed in greater detail in commonly assigned, U.S. Pat. No. 5,511,348, entitled FURNITURE SYSTEM. Space frame, is designed to be used as an integrated component together with wall systems 4, 5, and 7 specifically. It may be used as a stand along application in open plans, however, it may also be used as a "front-porch" application wherein select components of space frame 12 are used together with enclosed or open offices embodying Zone wall system 5. Space frame system 12 in the illustrated example includes an overhead framework 82, comprising a plurality of beam segments 83 interconnected in an end-to-end fashion to form a rigid structure configured to be positioned above the floor surface 27. Space frame system 12 also includes a plurality of overhead support columns 84, each having an upper portion thereof connected with overhead framework 82, and a lower portion thereof shaped to abut the prefabricated floor system 13. It is to be understood that space frame system 12 can also be supported directly on the floor surface 27 of building room 2. In any event, columns 84 can support framework 82 in a freestanding fashion within building room 2 at a predetermined elevation above average user height or as connected to the Wall system as an integrated "front porch." Space frame system 12 also includes a plurality of individual panels 85 which have a lightweight construction to permit easy, manual, bodily translation of the same by an adult user. The panels 85 include connectors 86 that detachably mount the same on overhead framework 82 at various locations therealong in a manner in which panels 85 hang downwardly from overhead support 82 in a generally vertical orientation, and are readily and easily manually removable therefrom and reconfigurable thereon by the user. Panels 85 may include sound attenuation to facilitate partitioning, as well as special exterior surfaces for displays. The horizontal beam segments 83 of framework 82, as well as support columns 84 include utility raceways 87 and 88 associated therewith to facilitate providing utilities to the associated work area. In one example of the present invention, beam segments 83 and support columns 84 have substantially hollow constructions, forming raceways 87 and 88 therein, which are divided to physically separate power and cable wires. In the example illustrated in FIG. 1, space frame system 12 is positioned directly on top of prefabricated floor system 13, and a Zone wall panel 68 extends from the outside pair of support columns 84.

Figure 2:
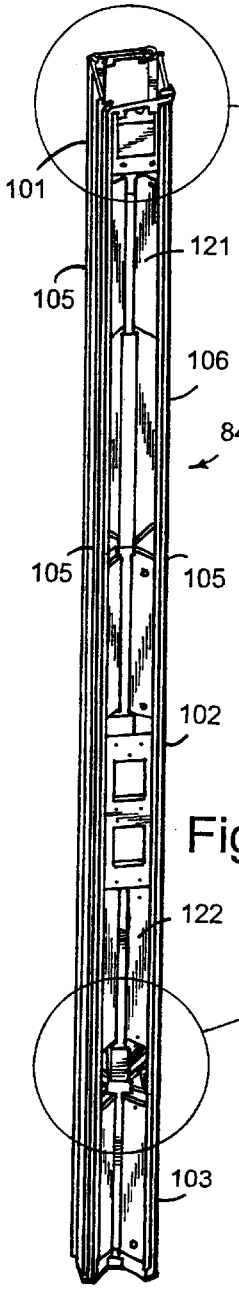
FIG. 2 is perspective view of the column shown in FIG. 1, wherein the outer covers have been removed to illustrate the internal construction of the beam.
Figure 4:
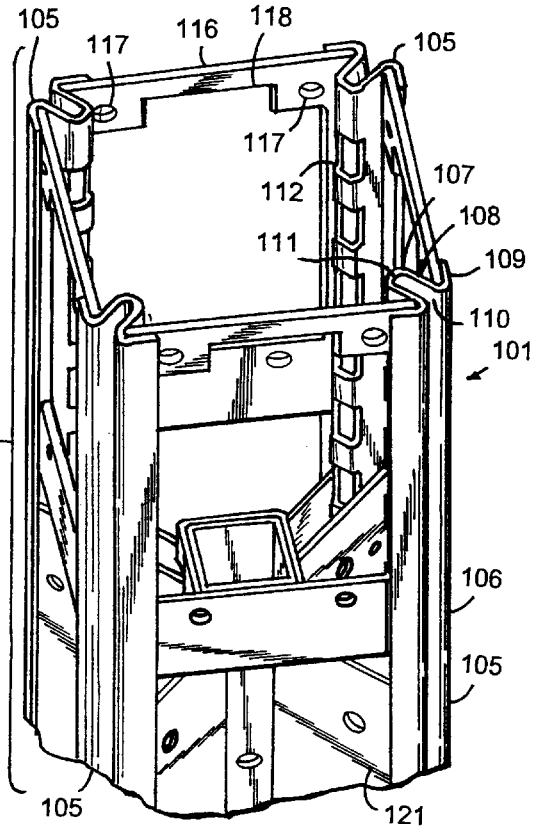
FIG. 4 is a fragmentary, perspective view of a top portion of the column.
Figure 3:
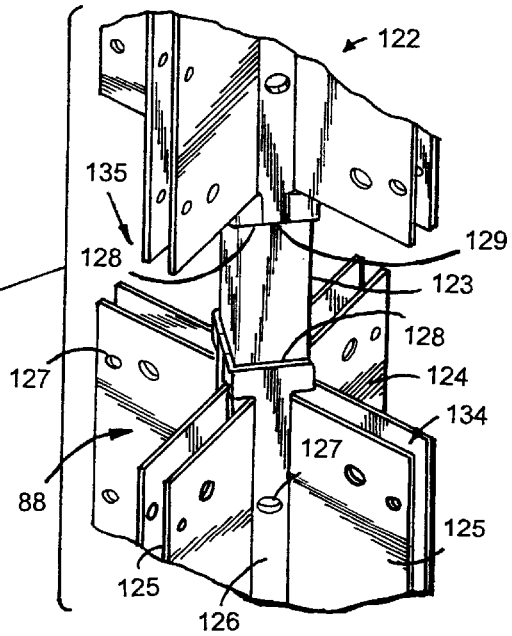
FIG. 3 is a fragmentary, perspective view of an inner core portion of the column showing the attachment of star elements to the central tube.

Referring now to FIG. 2, a vertical column 84 of the preferred embodiment is shown. Column 84 has an upper portion 101, an intermediate portion 102, and a bottom portion 103. Column 84 further comprises a rigid internal support structure comprising upper and lower star sections 121 and 122 and continuous vertical edges 105 of which at least one has a plurality of slots 112 (FIG. 4) for supporting office furniture items such as table 198 and shelf 199 as shown in FIG. 1.

In the preferred embodiment, upper portion 101 of column 84 comprises four vertical rails 106 positioned in a generally square cross-sectional pattern. Each vertical rail 106 is formed as a generally U-shaped channel 107 comprising parallel flanges 108 connected by web 111. Web 111 has a plurality of uniformly spaced slots 112 along the length of rail 106. Rails 106 are positioned and oriented such that web 111 faces an interior portion of column 84 with U-shaped channel 107 being aligned on the diagonals of the square or cross-section of column 84. Open portion 110 of U-shaped channel 107 faces an outer portion of beam 84. Flange ends 109 are bent away from open portion 110 of U-shaped channel 107 such that adjacent flange ends 109 of adjacent vertical rails 106 are essentially coplanar and parallel to one of the planar sides of the square cross-section of column 84.

Vertical mounting plates 116 extend between adjacent vertical rails 106 and are fastened to adjacent flange ends 109 of adjacent vertical rails 106. In the preferred embodiment, plates 116 are fastened to rails 106 by welding of plate 116 to flange ends 109. Vertical mounting plate 116 has holes 117 therein in a predetermined pattern for the mounting of horizontal beam 83, details of beam 83 and the mounting of same are more fully described below. Mounting plate 116 also has aperture 118 for the routing of electrical and utility conduits from column 84 to beam 83.

The interior support structure of column 84 in the preferred embodiment comprises upper star section 121 and lower star section 122. Star sections 121 and 122 are identical in configuration except for the length of respective central tubes 123. Lower star section 122 will be described herein with the understanding that upper star section 121 is of identical construction. Star section 122 is comprised of central tube 123 and a plurality of star elements 124 affixed to central tube 123. In the preferred embodiment, central tube 123 is typically a hollow square tube having four external faces.

Each star element 124 is formed in a substantially V-shaped channel, each element 124 comprised of legs 125 adjoined at a lower apex 126. Lower apex 126 may comprise a flat section for mating with square central tube 123. The star elements 124 in the preferred embodiment have a flat lower apex 126 having a width less than the width of an external face of central tube 123. Flat apex 126 has at least two holes 127 therethrough, such holes being used to attach star element 124 to central tube 123. In the preferred embodiment, star elements 124 are welded to central tube 123 at holes 127. However, other methods of attachment are contemplated to be within the scope of the instant invention. Each star element 124 has a first end tab 128 at one end and second end tab 129 at a second end of star element 124. First end tab 128 is formed in a substantially U-section such that the U-section of tab 128 corresponds to and fits laterally across one face of central tube 123 and partially around adjacent faces of central tube 123. Second end tab 129 is substantially the same width or slightly less than the width of flat apex 126 and abuts a central portion of a face of central tube 123.

Adjacent star elements 124 as viewed around the periphery of central tube 123 are in a head-to-toe relationship, opposite star elements 124 are oriented with first end tab 128 abutting and embracing the face of central tube 123 which apex 126 abuts. Star elements 124 abutting the remaining faces of central tube 123 are oriented such that second end tab 129 is positioned between end tabs 128 on the first star elements 124. thus forming a central supporting structure having a star shaped cross-section.

Adjacent legs 125 of adjacent star elements 124 are in a parallel spaced apart relationship forming gap 134 therebetween. Gap 134 is formed as a result of flat apex 126 being of smaller dimension than an external face of central tube 123. The dimension of gap 134 is essentially equal to the external dimension of U-shape channel 107. During assembly of column 84, rails 106 are positioned such that U-shape channel 107 is nested between adjacent legs 125 of adjacent star elements 124. Legs 125 have holes 127 positioned proximate to the outer edge of legs 125 for the fastening of rail 106 to legs 125. In the preferred embodiment, the fastening of rail 106 to legs 125 is accomplished by welding at holes 127, thus forming a rigid internal support structure for column 84.

Each star section 121 and 122 has a set of star elements 124 located proximate an upper end of tube 123 and proximate a lower end of tube 123. The length of central tube 123 is greater than the combined length of the two star elements 124, thereby resulting in each set of star elements 124 being vertically displaced one from the other. The vertical separation of the star sections creates a cross-over portion 135 of star sections 121 and 122. Such cross-over portion 135 permits the transitioning of a utility conduit 197 from one vertical raceway 88 to an adjacent vertical raceway 88. Thereby permitting utility conduits 197 to be routed to any desired position within column 84.

Figure 5:
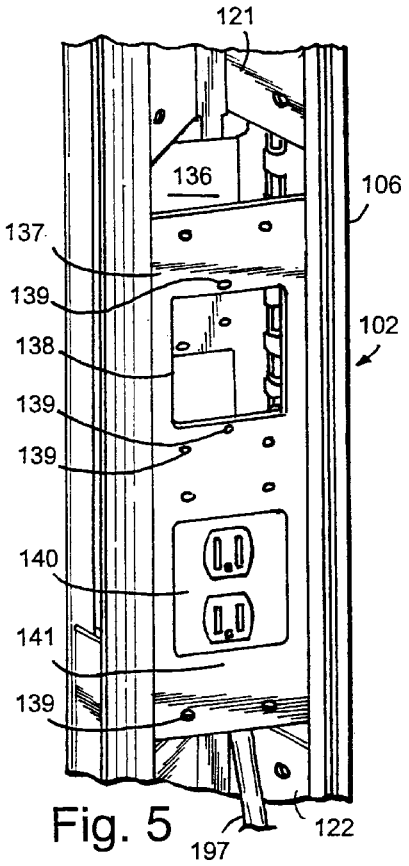
FIG. 5 is a fragmentary, perspective view of a central portion of the column.

Referring now to FIG. 5, illustrating intermediate portion 102 of column 84, upper and lower star sections 121 and 122 are shown in a vertically spaced apart relationship defining beltway 136 therebetween. Beltway 136 is positioned substantially at worksurface height and vertically corresponds to utility beltways 49 as depicted in FIG. 1. Beltway 136 functions as the terminal area on column 84 for the utilities routed therein for use by the user. Utility mounting plate 137 is positioned in beltway 136 between adjacent vertical rails 106 such that plate 137 abuts adjacent flange ends 109 of adjacent vertical rails 106. In the preferred embodiment, utility mounting plate 137 is attached to flange ends 109 by welding.

Utility mounting plate 137 has at least one aperture 138 for the mounting of utility receptacle 140 therein. Mounting holes 139 are positioned in a predetermined configuration with respect to aperture 138 such that a conventional utility receptacle 140 may be mounted therein with screws 141. Additional mounting holes 139 are positioned in a predetermined hole pattern with respect to aperture 138 to permit the mounting of a terminal box for shielding of the electrical wires and exposed electrical terminals of conduit 197 and receptacle 140.

Figure 6:
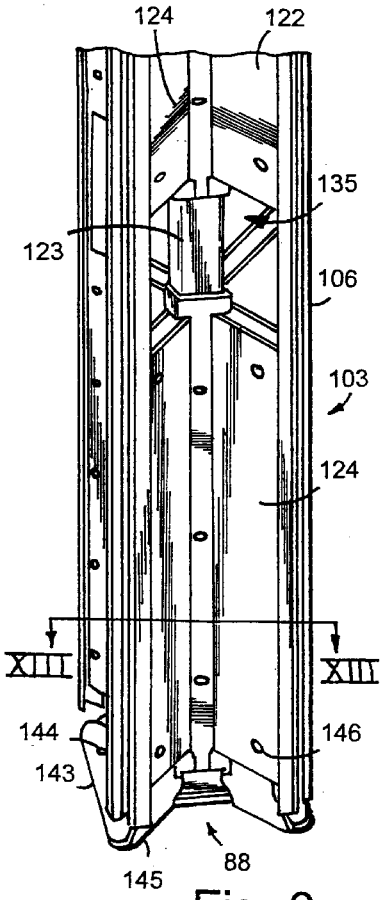
FIG. 6 is a fragmentary, perspective view of a bottom portion of the column.
Figure 13:
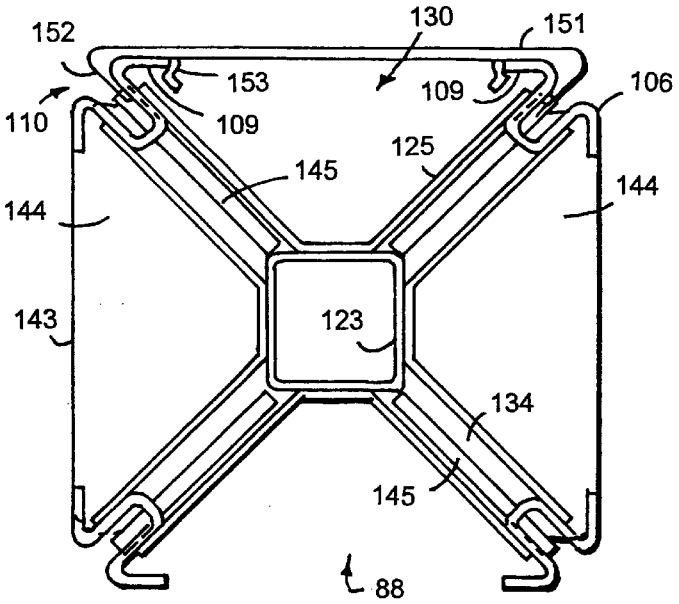
FIG. 13 is a sectional plan view of the bottom portion of the column.

Lower portion 103 of column 84 is shown generally in FIG. 6 and in cross-section in FIG. 13. Vertical rails 106 can be seen mounted to star elements 124 which in turn are mounted about central tube 123 with vertically adjacent star elements 124 in a spaced apart relationship defining cross-over area 135. The V-shape of star element 124 in combination with vertical rails 106 define vertical raceway 88. The bottom end of column 84 comprises a horizontal bottom plate 143 for abutting a floor surface such as floor surface 27 or raised floor 13. Bottom plate 143 is formed in a "bow-tie" configuration. The larger end portions of the bow-tie having holes 144 for affixing column 84 to a floor surface. The narrow central section of bottom plate 143 positionally corresponds to central tube 123, thus forming opposite open V-sections which further define vertical raceways 88 in column 84. Gussets 145 are attached to bottom plate 143 and provide support for column 84 by being positioned in gap 134 between star element legs 125 and welded thereto at a lower end of star segment 122 as shown in FIG. 13.

Raceway 88 in column 84 is enclosed with column cover 151 which provides a decorative face to column 84 matching the aesthetics of furniture system 1. Covers 151 extend the length of column 84 and are attached thereto by snapping into place. Cover 151 when viewed in cross-section (FIG. 13) has legs 152 at each end, leg 152 forming a 45 degree angle with respect to the face of cover 151. Covers 151 also have resilient fingers 153 extending from a rear face thereof and laterally positioned to interferingly engage flange ends 109 of vertical rails 106. Cover 151 is installed over raceway 88 by inserting legs 152 within open section 110 of rails 106 and 'snapping' cover 151 into place, resilient fingers 153 engaging flange ends 109 thereby maintaining cover 151 in an engaging relationship with column 84.

Figure 14:
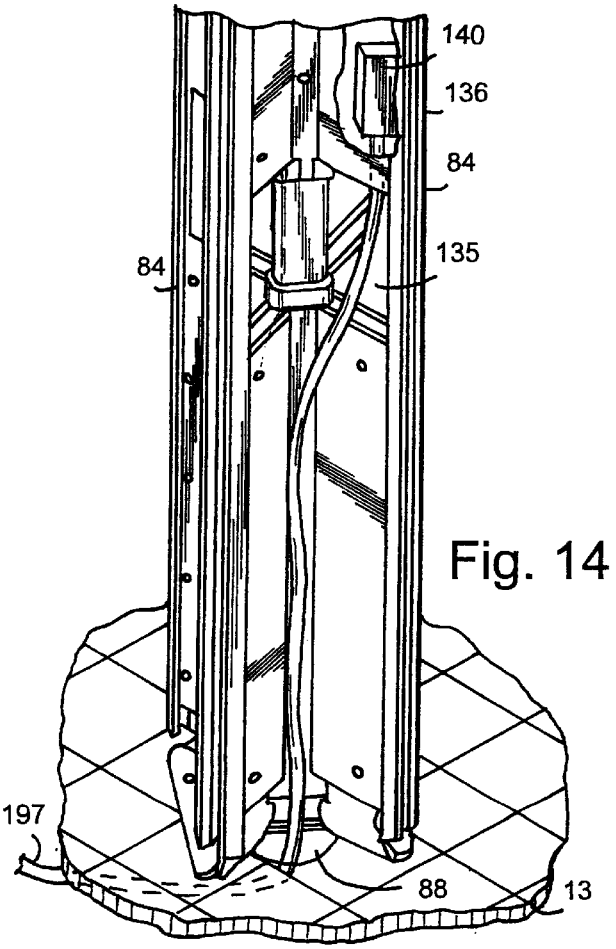
FIG. 14 is a fragmentary, perspective view of a column mounted to a floor surface and a utility conduit routed therein.

FIG. 14 shows a floor in-feed of utilities, one of the possible utility in-feeds to column 84. Utility in-feeds to column 84 can also be accomplished from adjacent or perpendicular walls or from the ceiling. A column 84 is shown mounted to raised floor 13 whereby utility conduit 197 is routed from below raised floor 13 into vertical raceway 88 of column 84. Utility conduit 197 transitions to an adjacent raceway 88 at cross-over 135. Conduit 197 extends vertically along adjacent raceway 88 to beltway 136 and terminates at utility receptacle 140.

Figure 8:
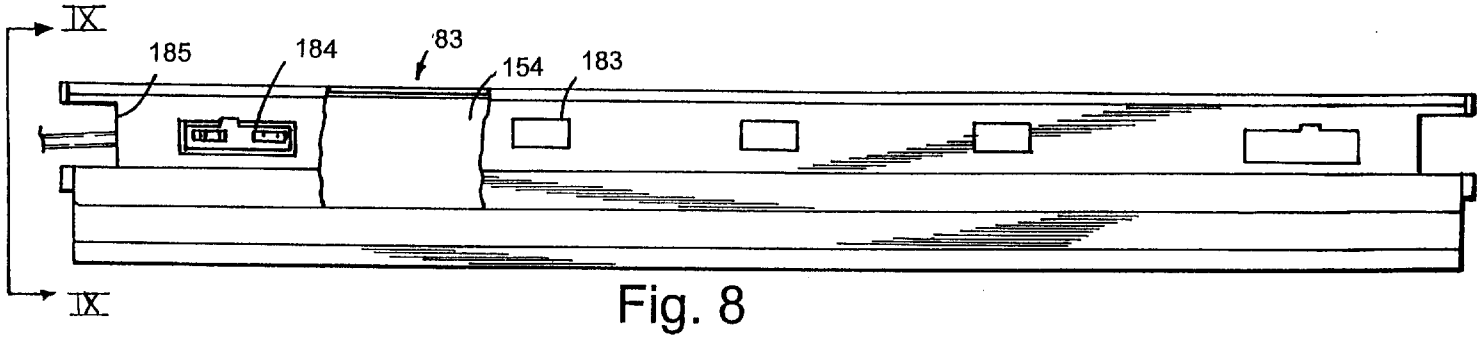
FIG. 8 is a side view of the beam shown in FIG. 1.
Figure 10:
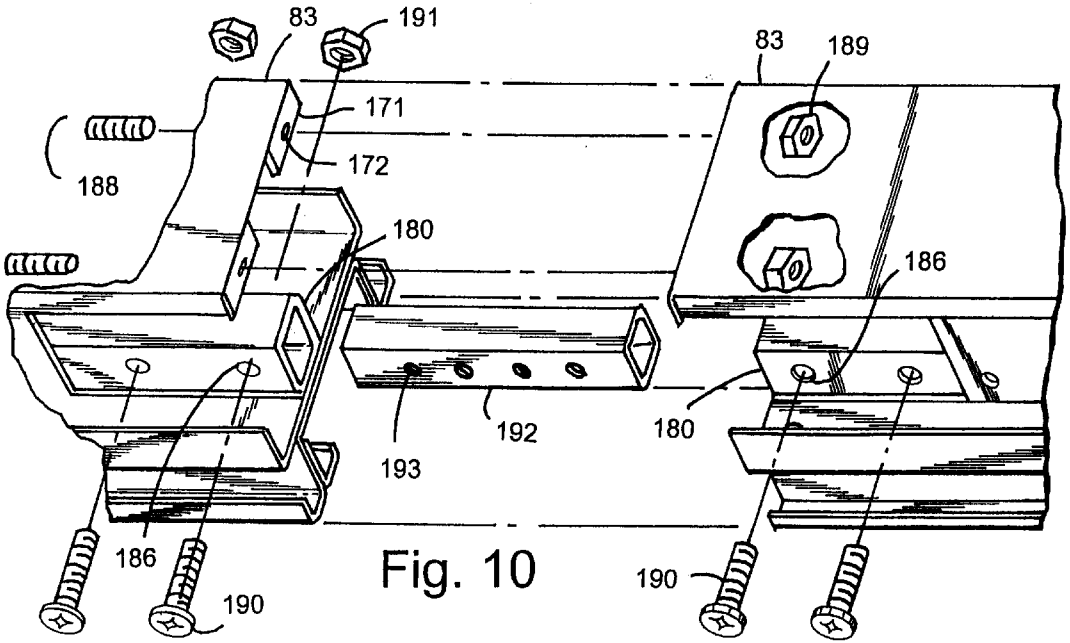
FIG. 10 is an exploded, perspective view of two beams in an end-to-end abutting relationship and the interconnecting relationship thereof.
Figure 9:
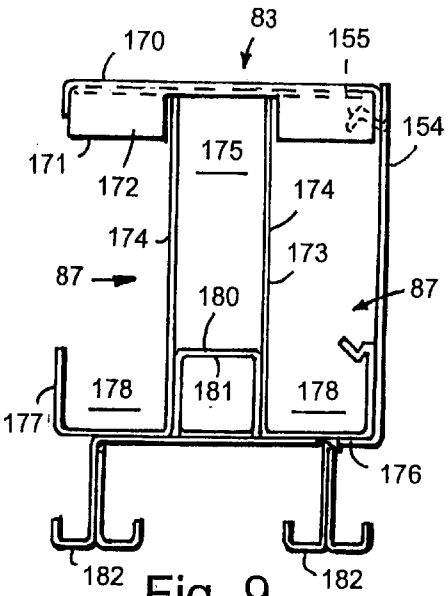
FIG. 9 is an end view of the beam shown in FIG. 1.

FIGS. 8 and 9 disclose horizontal beam segment 83 comprised of top cap 170 having end flanges 171 depending at substantially right angles therefrom at each end of beam 83. End flange 171 has mount holes 172 extending therethrough corresponding in size and position to top holes 117 in vertical mounting plate 116 on column 84. Beam 83 further comprises bottom cap 176 having upturned flanges 177 on either side thereof defining troughs 178. Top cap 170 and bottom cap 176 are maintained in a vertically spaced apart relationship by web 173. Web 173 is comprised of laterally spaced apart walls 174 defining web interior 175. Top cap 170, web wall 174, and bottom cap 176 define horizontal raceways 87 extending the length of beam 83. Horizontal receptacle 180 of square tubular cross-section is positioned at each end of beam 83 and is laterally centered within the beam at a lower portion of web interior 175 adjacent to an upper surface of bottom cap 176. A plurality of J-channels 182 depend from a lower surface of bottom cap 176. In the preferred embodiment, each beam 83 has two sets of back-to-back J-channels 182. Each set of J-channels 182 is positioned laterally proximate an outer face of beam 83.

Web walls 174 have at least one and preferably a plurality of apertures 183 extending therethrough at intermediate points of beam 83 to permit the routing of utility conduits between interior portion 175 and raceway 87. Web walls 174 also have at least one aperture 184 for receiving electrical power blocks in walls 174 and in the preferred embodiment proximate each end of beam segment 83. Recesses 185 defined by top cap 170, bottom cap 176, and ends of walls 174 at the ends of beam segment 83 permit the routing of utility conduit 197 to either raceway 87 or interior web portion 175 at the beam ends thereof.

Beam segments 83 can assume a variety of lengths, however in the preferred embodiment, beams 83 comprise 2 primary lengths of substantially five and eight feet. The eight foot beam segment 83 is typically adjoined to columns 84 at the ends of the beam thereof which the five foot beam segments 83 are typically adjoined in an end-to-end linear relationship to form a longer, ten foot, continuous beam segment. The end-to-end mating of beam segments 83 is accomplished by inserting connector bar 192 in horizontal receptacles 180 of each beam segment 83. Connector bar 192 is of square tubular cross-section, the external dimensions thereof are such that connector bar 192 is telescopically received by horizontal receptacle 180 of beam 83. Connector bar 192 has mounting holes 193 extending laterally therethrough, holes 193 positionally corresponding to holes 186 in horizontal receptacle 180 of beam 83. To maintain beams 83 in a secure end-to-end relationship, bolts 190 are inserted in axially aligned holes 186 of horizontal receptacle 180 and holes 193 of connector bar 192 and nuts 191 are threaded thereon. End flanges 171 of top caps 170 mate in an abutting relationship wherein holes 172 in flanges 171 are in axial alignment. Screws 188 are inserted through holes 172 and nuts 189 are threaded thereon. Beam segments 83 are thus connected in an end-to-end fashion and are rigidly maintained thereby.

Figure 7:
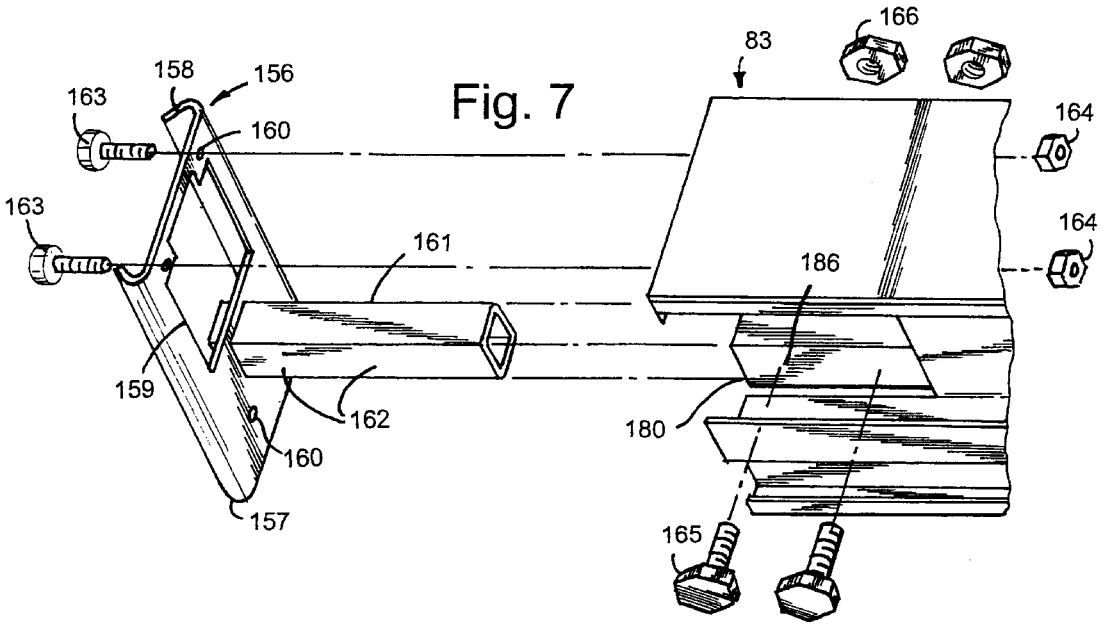
FIG. 7 is a perspective, exploded view of the connector and end of the beam showing the interconnecting relationship for mounting the beam to the connector.

FIG. 7 illustrates connector 156 for connecting beam 83 to upper portion 101 of column 84. Connector 156 comprises mounting plate 157 and connector support tube 161. Connector support tube 161 is typically of square tubular cross-section, the external dimensions of which are such that tube 161 can be telescopically received by horizontal receptacle 180 in beam end 83. Support tube 161 has holes 162 extending laterally therethrough and positioned to axially align with holes 186 in horizontal receptacle 180 of beam segment 83. Support tube 161 is affixed to connector plate 157. In the preferred embodiment, connector tube 161 extends through plate 157 and is welded in place. Connector plate 157 has aperture 159 extending therethrough, aperture 159 corresponding in shape and position to aperture 118 of vertical plate 116 at the upper portion 101 of column 84. Holes 160 extend through connector plate 157 and correspond to the pattern and position of holes 117 in plates 116 of column 84. In the preferred embodiment, connector plate 157 is a flat plate. However, lips 158 can be formed at the vertical edges of connector plate 157 to engage flanges 108 of rails 106 on beam 84 in a bayonet fashion.

Figure 11:
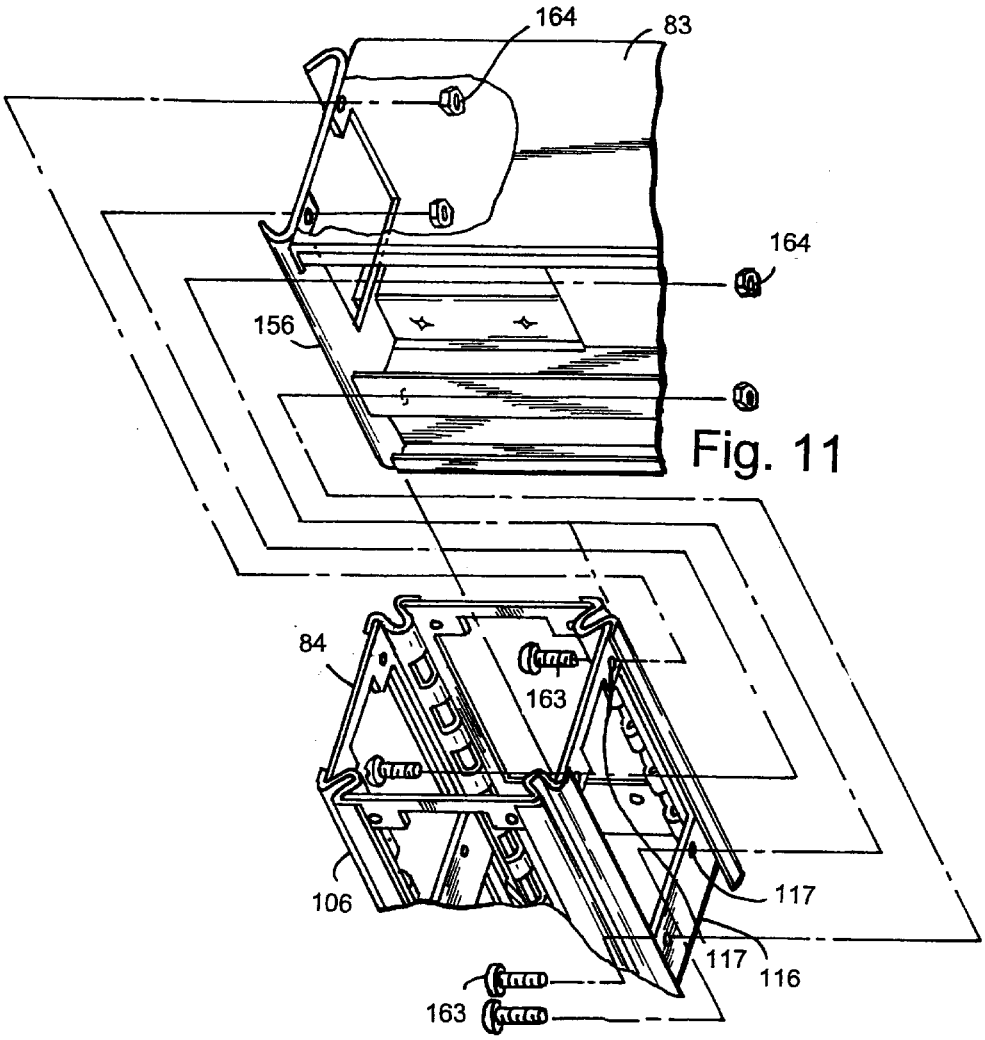
FIG. 11 is an exploded, perspective view of a beam mated to a connector and subsequently mated to a top portion of a column.
Figure 12:
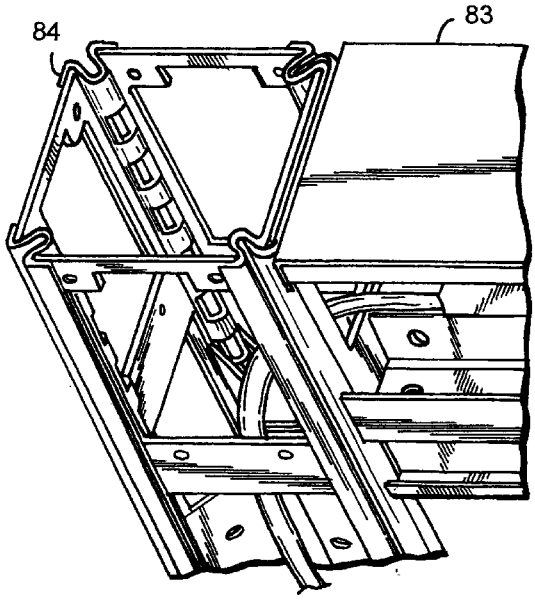
FIG. 12 is a perspective fragmentary view of a column, connector, and beam in their final mated relationship.

FIGS. 7 and 11 illustrate the mounting of beam 83 to column 84 utilizing connector 156. Support tube 161 of connector 156 is telescoped into horizontal receptacle 180 of beam 83. Bolts 165 are inserted through holes 186 and 162 of horizontal receptacle 180 and connector tube 161, respectively, thereby maintaining connector tube 161 and receptacle 180 in a telescoped relationship. Nuts 166 are threaded to bolts 165 to secure tube 161 to receptacle 180. Combined beam 83 and connector 156 are abutted against column 84 such that holes 117 in vertical plate 116 of column 84 are aligned with holes 160 in connector plate 157. Screws 163 are inserted through aligned holes 117 and 160, respectively, and nuts 164 are threaded thereon to secure connector 156 to column 84. Screws 163 through top holes 117 in plate 116 and connector plate 157 also engage holes 172 in end flange 171 of beam 83.

Referring again to FIG. 9, raceway 87 is covered by beam cover 154 affixed to an outer side thereof. Decorative cover 154 has resilient fingers 155 which engage top cap 170 and flange 177 of lower cap 176 thereby maintaining cover 154 in an engaging relationship with beam 83. Decorative cover 151 in FIG. 13 performs an analogous function with respect to the column.

In use, a horizontal grid 82 of beam segments 83 forming a combination of square or rectangular sections are supported by columns 84 at the intersections of beams 83. Columns 84 may freely rest on floor surface 27 or be attached thereto with fasteners engaging holes 144 in column 84 bottom plates 143. Alternatively, columns 84 may be mounted on raised floor surface 13 wherein column 84 is aligned and in communication with a raceway under floor 13 wherein utility conduits 197 are routed. The conduits 197 within the raceway under floor 13 are routed upwardly through raceways 88 in columns 84 for utility distribution at beltway 136. Conduits 197 can also be routed by vertical in raceways 88 through apertures 118 and 159 in columns 84 and connectors 156 respectively, and thereinto raceways 87 of beams 83.

Overhead grid 82 of beams 83 may also be interconnected to raceways 48 of Plus wall system 4 or raceways 61 of either Zone wall system 5 or Link wall system 7. Columns 84 may also be positioned adjacent wall systems 5 and 7 whereby beltway 136 vertically corresponds to and are in communication with beltways 49 and 70. Utilities in beltways 49 and 70 may be transitioned into columns 84 through beltway 136; however, in the preferred embodiment, such a transition is not utilized.

The support column 84 and beam 83 disclosed herein can be combined with wall systems 4, 5, and 7 in an limitless number of arrangements and configurations. Some examples not illustrated in the accompanying figures include: beam 83 can serve as a utility bridge between two separate Zone walls 5; a 'porch' of spaceframe columns 84 and beams 83 can be attached to an office constructed from the Zone wall system 5; or a series of alternating spaceframe areas and Zone wall 5 constructed offices can be arranged in room 2. The possibilities are bounded only by the needs and desires of the users.

Individual panels 85 are mounted to overhead framework 82 such that connectors 86 on panels 85 engage J-channels 182 on beams 83. Connectors 86 permit the easy translation of panels 85 longitudinally along beam 83 between adjacent columns 84. Panels 85 may comprise projection screens, marker boards, or privacy panels. Lighting fixtures may also be suspended from or attached to beams 83 deriving their required electrical power from the electrical conduits 197 routed along raceways 87 in beams 83. Furniture items such as table 198 may be partially supported by columns 84 by means of interconnecting an end of the furniture item in slots 112 in vertical rail 106 of column 84. Additionally, shelf 199 may be totally supported by column 84 wherein shelf 199 or a similar office accessory engages slots 112 in one or more vertical rail 106 of column 84.

The furniture system disclosed above includes an overhead framework having a plurality of horizontal beam segments interconnected in an end-to-end fashion to form a rigid structure configured to be positioned above the floor surface and further includes a plurality of overhead support columns, each having an upper portion thereof connected with the overhead framework, and a lower portion thereof shaped to abut the floor surface and thereby support the overhead framework thereon in a freestanding fashion at a predetermined elevation above average user height. Each of the overhead support columns and beams further include an interior support structure forming raceways therein for routing utility conduits throughout the grid. The overhead support columns also have a plurality of slots through vertical edges thereof for supporting office furniture items and office accessories.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. An integrated prefabricated furniture system for fitting-out a building room of the type having a generally open plan and having an associated floor surface, comprising:

an overhead framework comprising a plurality of horizontal beam segments interconnected in an end-to-end fashion to form a rigid structure configured to be spaced above the floor surface; and a plurality of freestanding overhead support columns, each having an upper portion connected with said overhead framework, and a lower portion shaped to abut the floor surface and thereby support said overhead framework in a freestanding fashion at a predetermined elevation above average user height, each of said overhead support columns further comprising an interior support structure, said interior support structure comprising at least two vertically separated sections, each said section extending radially outward from a center thereof and terminating to define at least three vertical edges forming substantially planar faces therebetween, and vertical rails affixed at said edges maintaining said sections in vertical separation, wherein at least one of said vertical rails has a slots therein for supporting office furniture items and office accessories.

2. The furniture system according to claim 1, wherein:

said vertical rails each comprise a U-shaped rail having flanges connected by a web.

3. The furniture system according to claim 1, wherein:

said interior support structure forms parallel vertical raceways between said vertical edges for routing utility conduits.

4. The furniture system according to claim 3, wherein:

said parallel vertical raceways in said support columns have cross-over portions intermediate to ends of said support column so that the utility conduits can be routed from one of said vertical raceways to an adjacent said vertical raceway.

5. The furniture system according to claim 4, wherein:

said vertical rails comprise a U-shaped rail having flanges connected by a web.

6. The furniture system according to claim 3, wherein:

said vertically separated sections define therebetween a beltway at an intermediate portion of said support column on at least one of said planar faces such that utilities routed within said support column can be terminated at said beltway for access by a user.

7. The furniture system according to claim 6, wherein:

an upper portion of at least one of said faces of said column defines an aperture adapted to communicate with utility raceways on associated furniture system panels.

8. An integrated prefabricated furniture system for fitting-out a building room of the type having a generally open plan and having an associated floor surface, comprising:

an overhead framework comprising a plurality of horizontal beam segments interconnected in an end-to-end fashion to form a rigid structure configured to be spaced above the floor surface; and a plurality of freestanding overhead support columns, each having an upper portion connected with said overhead framework, and a lower portion shaped to abut the floor surface and thereby support said overhead framework in a freestanding fashion at a predetermined elevation above average user height, each of said overhead support columns further comprising an interior support structure, said interior support structure extending radially outward from a center thereof and terminating to define at least three vertical edges forming substantially planar faces therebetween, said interior support structure further including vertical U-shaped rails; each said vertical U-shaped rail forming sa id vertical edges having rail flanges connected by a web, wherein each said vertical U-shaped rail defines an open interior portion that faces away from an interior portion of said support column, and said rail flanges each include flange ends bent away from said interior portion of said U-shaped rail such that adjacent said flange ends of adjacent rails are essentially coplanar.

9. An integrated prefabricated furniture system for fitting-out a building room of the type having a generally open plan and having an associated floor surface, comprising:

an overhead framework comprising a plurality of horizontal beam segments interconnected in an end-to-end fashion to form a rigid structure configured to be spaced above the floor surface:

a plurality of freestanding overhead support columns, each having an upper portion connected with said overhead framework, and a lower portion shaped to abut the floor surface and thereby support said overhead framework in a freestanding fashion at a predetermined elevation above average user height, each of said overhead support columns further comprising an interior support structure, said interior support structure extending radially outward from a center thereof and terminating to define at least three vertical edges forming substantially planar faces therebetween, said interior support structure further forming vertical parallel raceways between said vertical edges for routing utility conduits and having cross-over portions intermediate to ends of said support column so that the utility conduits can be routed from one of said vertical raceways to an adjacent said vertical raceway; and a plurality of U-shaped vertical rails forming said vertical edges, each U-shaped rail having flanges connected by a web and defining an open interior portion that faces away from an interior portion of said support column, and said rail flanges each include flange ends bent away from said interior portion of said U-shape rail such that adjacent flange ends of adjacent rails are essentially coplanar, wherein at least one of said vertical rails has a slots therein for supporting office furniture items and office accessories.

10. An integrated prefabricated furniture system for fitting-out a building room of the type having a generally open plan interior and having at least one utility source comprising:

an overhead framework comprising a plurality of horizontal beam segments interconnected in an end-to-end fashion to form a rigid structure configured to be positioned above the floor surface; and a plurality of freestanding overhead support columns, each having an upper portion connected with said overhead framework, and a lower portion thereof shaped to abut the floor surface and thereby support said overhead framework in a freestanding fashion at a predetermined elevation above average user height, wherein said overhead support columns further comprise an interior support structure including at least two vertically separated sections forming parallel vertical raceways for routing utility conduits therein from the at least one utility source in the building room, and vertical rails affixed to edges of said sections maintaining said sections in vertical separation.

11. The furniture system according to claim 10, wherein:

each said support column defines cross-over portions that extend between said vertical raceways intermediate to ends of said support column so that utility conduits can be routed from one of said vertical raceways to an adjacent vertical raceway.

12. The furniture system according to claim 11, wherein:

at least one of said support columns has a utility in-feed, said in-feed aligned with the at least one utility source in the building room.

13. The furniture system according to claim 10, wherein:

said support columns each further defines a beltway at an intermediate portion of at least one of said vertical raceways such that utilities routed within said support column can be terminated at said beltway for use by a user.

14. The furniture system according to claim 13, wherein:

each said support column defines cross-over portions that extend between said vertical raceways intermediate the length of said support column so that utility conduits can be routed from one of said vertical raceways to an adjacent vertical raceway.

15. The furniture system according to claim 14, wherein:

at least one of said support columns has a utility in-feed, said in-feed aligned with the at least one utility source in the building room.

16. The furniture system according to claim 13, wherein:

at least one of said support columns includes a face at said upper portion; and said face defines an aperture therethrough adapted to communicate with utility raceways in associated furniture system panels.

17. The furniture system according to claim 16, wherein:

each said support column defines cross-over portions extend between said vertical raceways intermediate to ends of said support column so that utility conduits can be routed from one of said vertical raceways to an adjacent vertical raceway.

18. The furniture system according to claim 17, wherein:

at least one of said support columns has a utility in-feed, said in-feed aligned with the at least one utility source in the building room.

19. An integrated prefabricated furniture system for fitting-out a building room of the type having a generally open plan interior including freestanding panels or wall mounted panels of the type having horizontally extending utility raceways positioned along an upper portion thereof and having at least one utility source comprising:

an overhead framework comprising a plurality of horizontal beam segments interconnected in an end-to-end fashion to form a rigid structure configured to be positioned above the floor surface; and a plurality of freestanding overhead support columns, each of said columns having an upper portion thereof connected with said overhead framework, and a lower portion thereof shaped to abut the floor surface and thereby support said overhead framework thereon in a freestanding fashion at a predetermined elevation above average user height wherein each of said overhead support columns further comprises a plurality of interior vertical raceways each comprising at least two vertically separated sections for routing utility conduits, and a beltway at an intermediate portion of each said support column, said beltway defined by said vertically separated sections of said raceway such that utilities routed within said support column can be terminated at said beltway for access by a user, said section maintained in vertical separation by vertical rails affixed to edges thereof.

20. The furniture system according to claim 19, wherein:

at least one of said support columns has a utility in-feed, said in-feed aligned with the at least one utility source in the building room.

21. The furniture system according to claim 19, wherein:

at least one of said support columns includes a face at said upper portion; and said face includes an aperture therethrough adapted to communicate with the horizontally extending utility raceways in the furniture system panels.

22. An overhead support column for use in furniture systems to support an overhead framework above a floor surface comprising:

an interior support structure comprising at least two vertically separated sections, each said section extending radially outward from a central vertical longitudinal axis thereof and of a length to support the overhead framework at a predetermined elevation above average user height;

at least three vertical edges at ends of said radially extending interior support structure forming substantially planar faces between adjacent ones of said vertical edges, of which at least one of said vertical edges has a plurality of slots therethrough for supporting furniture items and accessories; and a vertical rail affixed to each of said edge to maintain said sections in vertical separation.

23. The support column for use in furniture systems according to claim 22 wherein said interior support structure further comprises:

a vertical central tube; and star elements fastened to said central tube and radiating therefrom to said edges such that a cross-section of said column is formed in a star-like pattern.

24. An overhead support column for use in furniture systems to support an overhead framework above a floor surface comprising:

an interior support structure extending radially outward from a central vertical longitudinal axis thereof and of a length to support the overhead framework at a predetermined elevation above average user height; and at least three vertical edges at ends of said radially extending interior support structure forming substantially planar faces between adjacent ones of said vertical edges, of which at least one of said vertical edges has a plurality of slots therethrough for supporting furniture items and accessories, wherein said at least three vertical edges comprise at least three parallel U-shaped vertical corner rails arranged in a vertical column forming a polygon and fastened to said interior support structure, one of said vertical corner rails rail being positioned at each corner of said polygon and extending a length of said support column, said U-shaped rails comprising side flanges and an orthogonal web connecting said flanges wherein said web faces said interior support structure.

25. The support column for use in furniture systems according to claim 22 wherein:

said plurality of slots are a plurality of uniform evenly spaced slots through said connecting web in said corner rail extending the length of said corner rail.

26. The support column for use in furniture systems according to claim 1 wherein:

ends of said corner rail flanges are bent away from an interior portion of said U-shape such that adjacent said flange ends of adjacent corner rails are essentially coplanar.

27. An overhead support column for use in furniture systems to support an overhead framework above a floor surface comprising:

an interior support structure extending radially outward from a central vertical longitudinal axis thereof and of a length to support the overhead framework at a predetermined elevation above average user height, said interior support structure including a vertical central tube and star elements fastened to said central tube and radiating therefrom to said edges such that a cross section of said column is formed in a star-like pattern; and at least three vertical edges at ends of said radially extending interior support structure forming substantially planar faces between adjacent ones of said vertical edges, of which at least one of said vertical edges has a plurality of slots therethrough for supporting furniture items and accessories, wherein said at least three vertical edges each comprises a parallel U-shaped corner rail, said corner rails arranged in a vertical column forming a polygon and fastened to said interior support structure, one said corner rail being positioned at each corner of said polygon and extending a length of said support column and fastened to said star elements, said U-shaped rails comprising side flanges and an orthogonal web connecting said flanges wherein said web faces said interior support structure.

28. The support column for use in furniture systems according to claim 27 wherein:

said plurality of slots are a plurality of uniform evenly spaced slots through said connecting web in said corner rail extending a length of said corner rail.

29. The support column for use in furniture systems according to claim 28 wherein:

ends of said corner rail flanges are bent away from an interior portion of said U-shape such that adjacent said flange ends of adjacent corner rails are essentially coplanar.

30. The support column for use in furniture systems according to claim 29 wherein:

each star element is a generally V-shaped element comprising two legs joined at a lower apex wherein said apex of said V-shape is fastened to said central tube and said legs of said V-shape radiate to adjacent flanges of adjacent corner rails forming generally V-shaped channels between adjacent corner rails, and said legs are fastened to said corner rails such that adjacent legs of adjacent star elements are in a parallel spaced apart relationship, said spaced apart relationship being defined by said U-shaped corner rail.

31. The support column for use in furniture systems according to claim 28, wherein:

a horizontal bottom plate conforming to said polygonal shape of said support column is fastened to a bottom end of said support column, said bottom plate having holes positioned at the bottom of at least two essentially opposite generally V-shaped channels for mounting said support column to a floor.

32. The support column for use in furniture systems according to claim 31 further comprising:

vertical mounting plates at a top end of said column extending between and fastened to adjacent said bent flange ends of adjacent said corner rails, said plates being adapted for mounting a horizontal beam thereto.

33. The support column for use in furniture systems according to claim 32 wherein:

said support column comprises two sets of star elements, one set proximate to an upper portion of said support column and a second set proximate to a lower portion of said support column, said sets being vertically spaced apart.

34. The support column for use in furniture systems according to claim 33 further comprising:

an upper central tube, and a lower central tube, each said tube comprising a set of star elements at an upper tube end and a set of star elements at a lower tube end, said central tubes being vertically displaced from one another and having a common vertical longitudinal axis.

35. The support column for use in furniture systems according to claim 34 further comprising:

plates at an intermediate point of said support column corresponding to said vertical position on said support column wherein said central tubes are displaced one from the other, said plates extending between and fastened to adjacent said bent flange ends of adjacent said corner rails.

36. The support column for use in furniture systems according to claim 31 further comprising:

cover elements extending between adjacent corner rails for covering said generally V-shaped channels, said cover elements further comprising resilient fingers for engaging said corner rails.

37. A column and beam system for open office plans and for routing of electrical utilities, comprising:

a horizontal beam adapted to distribute electrical utilities therethrough;

a connector fastened to each end of said horizontal beam, each said connector adapted for routing electrical utilities therethrough and having one mounting face; and a support column at each end of said horizontal beam and fastened to said mounting face, said support column vertically positioning the horizontal beam above a floor surface to permit passage of people under the horizontal beam, each of said columns comprising:

four substantially parallel U-shaped corner rails positioned in a vertically square arrangement and running a length of said support column, said corner rails comprising side flanges and a web connecting said side flanges and being arranged such that said web faces an interior portion of said support column;

a central square tube interior to said support column and equi-spaced from said corner rails and parallel thereto, diagonals of a cross-section of said tube being coincident with diagonals of said square arrangement formed by said corner rails;

two sets of star elements, one set proximate to an upper portion of said support column and a second set proximate to a lower portion of said support column, said star element sets being vertically spaced apart wherein each of said star elements is fastened to a face of said central tube, each of said star elements radiating from a point proximate to a vertical edge of said tube to said corner rail and parallel to one of said diagonals, wherein said tube, said star elements and said corner rails form four vertical generally V-shaped channels around said central tube;

vertical mounting plates at a top end of said support column extending between and fastened to adjacent flanges of adjacent corner rails, said plates having an aperture therein for routing the electrical utilities from said column to said beam and being adapted for mounting said mounting face of said connector thereto;

a bottom plate fastened to a bottom of the post, said plate having holes positioned at said bottom of two opposite generally V-shaped channels for mounting to a floor, said bottom plate formed to maintain the remaining two said V-shaped channels open at said bottom; and at least one plate at an intermediate point of said column, said plate extending between and fastened to adjacent corner rails, said plate being adapted for mounting utility receptacles thereto.

38. The column and beam system according to claim 37, wherein said connector comprises:

a vertical plate fastened to said vertical mounting plate on said column; and a support bar extending from a face of the vertical plate opposite said connector mounting face and fastened to said horizontal beam end.

39. The column and beam system according to claim 38, wherein the horizontal beam comprises:

an upper cap;

a lower cap; and a central vertical web connecting the upper cap and the lower cap, said vertical web comprising two spaced apart walls forming an interior portion of said vertical web, said interior portion in communication with said aperture in said vertical mounting plates of said column for routing the electrical utilities therethrough.

40. The column and beam system according to claim 39, wherein ends of upper cap comprise vertical flanges substantially coplanar with the beam end and wherein said horizontal beam further comprises:

a horizontal receptacle at each end of said beam positioned at a lower portion of said interior portion of said vertical web and aligned with a longitudinal axis of said beam for telescopically receiving said connector support bar.

41. The column and beam system according to claim 40, wherein:

said vertical plate of said connector is fastened to said vertical mounting plate on said support column;

said vertical flange of said end of said beam top is fastened to said connector vertical plate; and said connector support bar is telescopically received in said horizontal receptacle at said end of said beam and fastened therein.

42. The column and beam system according to claim 41, wherein said horizontal beam further comprises:

apertures through said walls of said web for distributing electrical utilities therefrom.

43. The column and beam system according to claim 42, wherein:

at least one aperture through said walls of said beam web is adapted to receive a power distribution block from a power distribution system.

44. The column and beam system according to claim 43, wherein said horizontal beam further comprises:

at least one J-shaped channel depending from said lower cap of said beam for hanging office accessories, office tools and the like therefrom.

45. The column and beam system according to claim 41, wherein said horizontal beam further comprises:

two horizontal beams abuttingly joined at one end and each beam joined to a column at an opposite end.

46. The column and beam system for according to claim 45, wherein said butt joint of said abutting beams further comprises:

a connector bar telescopically received in said horizontal end receptacle of each beam and fastened therein; and said end flange of each beam top cap fastened to adjoining said end flange of said other beam.

47. The column and beam system for according to claim 46, wherein said horizontal beam further comprises:

apertures through said walls of said web for distributing electrical utilities therefrom.

48. The column and beam system according to claim 47, wherein:

at least one aperture through said walls of said beam web is adapted to receive a power distribution block from a power distribution system.

49. The column and beam system for according to claim 48, wherein said horizontal beam further comprises:

at least one J-shaped channel depending from said lower cap of said beam for hanging office accessories, office tools and the like therefrom.

50. The column and beam system according to claim 48, wherein said horizontal beam further comprises:

cover elements extending between said top cap and said bottom cap and further comprising resilient legs for engaging said top cap and said bottom.

* * * * *

UNITED STATES PATENT AND TRADEMARK OFFICE

CERTIFICATE OF CORRECTION

PATENT NO. : 5,899,025

DATED : May 4, 1999

INVENTOR(S) : Daniel S. Casey et al.

It is certified that error appears in the above-identified patent and that said Letters Patent is hereby corrected as shown below:

ON THE TITLE PAGE:

Item [54] Title -

"Furniture System (Pathways-Spaceframe)" should be --Furniture System--.

Col. 1, line 13;

"5,517,348" should be --5,511,348--.

Col. 1, line 51;

Delete "both".

Col. 3, line 28;

"system" should be --systems--.

Col. 4, line 23;

"are" should be --is--,

Insert --are-- after "which".

Col. 4, line 56;

Before "perspective" insert --a--.

Col. 5, line 47;

",2" should be --2,--.

UNITED STATES PATENT AND TRADEMARK OFFICE

CERTIFICATE OF CORRECTION

PATENT NO. : 5,899,025

DATED : May 4, 1999

INVENTOR(S) : Daniel S. Casey et al.

It is certified that error appears in the above-identified patent and that said Letters Patent is hereby corrected as shown below:

Col. 9, line 23;

"124." should be --124,--.

Col. 12, line 23;

"fasteners" should be --fastener--.

Col. 12, line 30;

"by vertical" should be --vertically--.

Col. 12, line 39;

"are" should be --is--.

Col. 12, line 45;

"in an" should be --in a--.

Col. 13, claim 1;

After "said vertical rails has a" insert --plurality of--.

Col. 14, claim 8, line 40;

Before . insert --wherein at least one of said vertical rails has a plurality of slots therein for supporting office furniture items and office accessories--.

Col. 15, claim 9, line 6;

After "said vertical rails has a" insert --plurality of--.

Col. 15, claim 17, line 64;

After "portions" insert --that--.

UNITED STATES PATENT AND TRADEMARK OFFICE

CERTIFICATE OF CORRECTION

PATENT NO. : 5,899,025

DATED : May 4, 1999

INVENTOR(S) : Daniel S. Casey et al.

It is certified that error appears in the above-identified patent and that said Letters Patent is hereby corrected as shown below:

Col. 17, claim 24, line 17;

Delete "rail".

Col. 17, claim 25, line 23;

"claim 22" should be --claim 24--.

Col. 20, claim 46, line 36;

Delete "for".

Col. 20, claim 47, line 43;

Delete "for".

Col. 20, claim 49, line 52;

Delete "for".

Signed and Sealed this

Eleventh Day of July, 2000

*Attest:*

*Attesting Officer*

Q. TODD DICKINSON

*Director of Patents and Trademarks*